United States Patent [19]

Kim et al.

[11] Patent Number: 4,500,561

[45] Date of Patent: Feb. 19, 1985

[54] MINIMIZATION OF SPANGLING ON HOT DIP GALVANIZED STEEL STRIP

[75] Inventors: Yong-Wu Kim; Phillip L. Coduti, both of Munster; Brian A. Sok, Cedar Lake; William A. Carter, Munster, all of Ind.

[73] Assignee: Inland Steel Company, Chicago, Ill.

[21] Appl. No.: 516,997

[22] Filed: Jul. 25, 1983

[51] Int. Cl.[3] ..... B05D 1/04; B05D 1/18

[52] U.S. Cl. ..... 427/25; 427/32; 427/321; 427/329; 427/398.3; 427/433

[58] Field of Search ..... 427/398.3, 329, 321, 427/433, 436, 27, 32; 25; 118/628, 624, 630, 626

[56] References Cited

U.S. PATENT DOCUMENTS

| | | | |
|---|---|---|---|
| 2,094,583 | 10/1937 | Cook et al. | 427/283 |
| 2,605,377 | 4/1947 | Kaehni et al. | 219/281 |
| 2,994,618 | 1/1922 | Landgraf | 117/93 |
| 3,004,514 | 10/1961 | Loes | 118/628 |
| 3,148,080 | 5/1960 | Mayhew | 427/398.4 |
| 4,284,495 | 8/1981 | Newton | 209/3.1 |

FOREIGN PATENT DOCUMENTS

| | | | |
|---|---|---|---|
| 4139839 | 10/1979 | Japan | 427/32 |

OTHER PUBLICATIONS

Cox, Technical Paper FC81-433, "New Developments in Electrostatic Deposition of Functional Coatings", Society of Manufacturing Engineers, Dearborn, Michigan, 1981.

"Electrostatics and Its Application", John Wiley & Sons, New York, 1973, Chapter 11, Electrostatic Coating, pp. 250-269.

International Science and Technology, Jan., 1967, "Electrostatic Engineering", pp. 38-45.

*Primary Examiner*—Michael R. Lusignan

*Assistant Examiner*—Ken Jaconetty

*Attorney, Agent, or Firm*—Marshall, O'Toole, Gerstein, Murray & Bicknell

[57] ABSTRACT

The molten exterior surface portion of a hot dip galvanized steel strip is solidified after the strip is withdrawn from a bath of molten zinc by spraying finely divided particles of a liquid nucleating agent for initiating solidification. The particles are sprayed into an electrostatic field alongside the strip. The particles are initially directed along a path which avoids impingement against the strip. However, the smaller particles are attracted to the strip under the influence of the electrostatic field, to initiate solidification. The larger particles have a momentum along their path large enough to resist the influence of the electrostatic field, thereby permitting the larger particles to continue along a path which avoids impingement. This minimizes the formation of undesirably large spangles and an undesirable surface appearance on the strip.

23 Claims, 5 Drawing Figures

MINIMIZATION OF SPANGLING ON HOT DIP GALVANIZED STEEL STRIP

BACKGROUND OF THE INVENTION

The present invention relates generally to the production of hot dip galvanized steel strip and more particularly to a method and apparatus for minimizing spangling on such strip.

Hot dip galvanized steel strip is produced by passing a continuous steel strip through a bath of molten zinc or zinc alloy. When the strip is withdrawn from the molten bath, the surface thereof is covered with molten zinc which solidifies as the strip cools. Usually, as the molten zinc solidifies, the surface of the strip takes on the characteristic spangled appearance of a galvanized steel product. A spangled surface is undesirable under certain conditions of use, e.g., when the galvanized surface is to be painted. Attempts have been made to minimize spangling, and some of these previous attempts employed spraying onto the molten exterior surface portion of the strip, finely divided particles of a nucleating agent.

The theory underlying the employment of finely divided particles of nucleating agent is that, when such a particle impinges against the strip's molten exterior surface portion, solidification begins at the site where the particle impinges, and the solidification crystal thus formed grows outwardly from the site of impingement. It is these crystals of solidification which produce the spangled appearance, and the less these crystals are allowed to grow, the smaller the spangles appear. Therefore, when the molten exterior surface portion is impinged by a multitude of fine particles of nucleating agent, so many sites for solidification are formed, in such close proximity to each other, that they have virtually no chance to expand, and the visual appearance thus produced is an absence of spangling. The larger the particle size of the nucleating agent, the larger the spangle. Moreover, very large particles of nucleating agent (e.g., 3–5 mm) must be avoided because very large particles cause the formation of large, substantially round, water marks which are readily visible and create an undesirable surface appearance and texture on the strip.

Among the nucleating agents heretofore employed are water or aqueous solutions in the form of fine spray or fog or wet steam. However, a nucleating agent comprising finely divided particles of water or of an aqueous solution has drawbacks. Atomizing or dividing the nucleating agent into fine particles, employing conventional atomizing devices, produces a range of particle sizes including some large particles and can produce some very large particles which, upon impingement against the molten exterior surface portion of the galvanized steel strip, produce large spangles and/or the above-described undesirable surface appearance. Moreover, finely divided droplets of aqueous solution can coagulate during the journey from the spray nozzle to the surface upon which they impinge. A coagulated droplet impinging against that surface can have the same undesirable effect on surface appearance as a large or very large droplet originating as such at the spray nozzle.

Prior art patents which disclose the employment of finely divided particles of water or aqueous solution or wet steam to minimize spangling on hot dip galvanized steel strip include Cook et al., U.S. Pat. No. 2,094,583 and Mayhew, U.S. Pat. No. 3,148,080.

SUMMARY OF THE INVENTION

It is desirable to reduce the size of the spangles to less than about 1 mm (cross-sectional linear dimension tantamount to diameter if the spangles were true circles). Spangles larger than 1 mm are considered to be undesirably large when the galvanized strip is to be painted, for example.

The present invention comprises a method and apparatus for avoiding undesirably large spangles on hot dip galvanized steel strip and the undesirable surface appearance caused by impingement against the strip's molten exterior surface portion of relatively large particles and/or of very large particles of nucleating agent. As used hereinafter, and unless indicated otherwise, the term "large particles" encompasses both (a) those particles which produce unacceptably large spangles, and (b) a combination of (a) plus those particles which produce the aforementioned water marks causing an undesirable surface appearance and texture.

The method of the present invention comprises spraying a mixture of both large particles and small particles of nucleating agent, the small particles being of a size which produce desirably small spangles when they impinge against the molten exterior surface portion of the galvanized steel strip. After spraying, the small particles are segregated from the large particles. The large particles are directed to follow a path which is adjacent the moving strip but which avoids impingement of the large particles against the exterior surface portion of the strip. The small particles are directed toward the strip's exterior surface portion.

An electrostatic field alongside the coated strip is employed to segregate the particles and to direct the small particles toward the strip's exterior surface portion. All of the particles of nucleating agent are directed into the electrostatic field, but the large particles have imparted thereto a momentum along their path which is so large that the force required for the task of diverting the large particles from that path and directing the large particles toward the exterior surface portion of the strip exceeds the force in the electrostatic field which is available for that task.

The electrostatic field is formed by employing the coated strip as one electrode, providing it with an electrostatic charge having a first polarity. The other electrode is a corona blade positioned adjacent the strip, near the spray nozzles for the nucleating agent. As the particles of nucleating agent are sprayed into the electrostatic field, they are charged with an electrostatic charge having a second polarity opposite the polarity with which the strip is charged, thereby causing the particles to be attracted toward the strip.

The magnitude of the charge in the electrostatic field may be varied by varying the voltage employed. The extent of the electrostatic field may also be varied in a manner to be subsequently described.

By controlling the initial direction in which the particles of mixed size range are sprayed and the magnitude and extent of the electrostatic field, it is possible to divert for impingement against the strip's molten exterior surface only those particles of nucleating agent of a small size which produces the desirably small spangles, while simultaneously permitting the large particles, which produce the undesirably large spangles and the undesirable surface appearance, to follow a path which avoids impingement against the strip's molten exterior surface portion. Impingement by the large particles is either totally avoided or else is avoided until after the small particles have impinged to create the desirably small spangles, and the present invention covers both situations.

By proper adjustment of the relevant controls, namely the direction in which the particles of mixed size range are sprayed, and the magnitude and extent of the electrostatic field, the size of the spangles on the hot dip galvanized strip can be controlled and minimized to the extent desirable.

Other features and advantages are inherent in the method and apparatus claimed and disclosed or will become apparent to those skilled in the art from the following detailed description in conjunction with the accompanying diagrammatic drawing.

DETAILED DESCRIPTION

Figures 1, 2, 3, 4, 5:
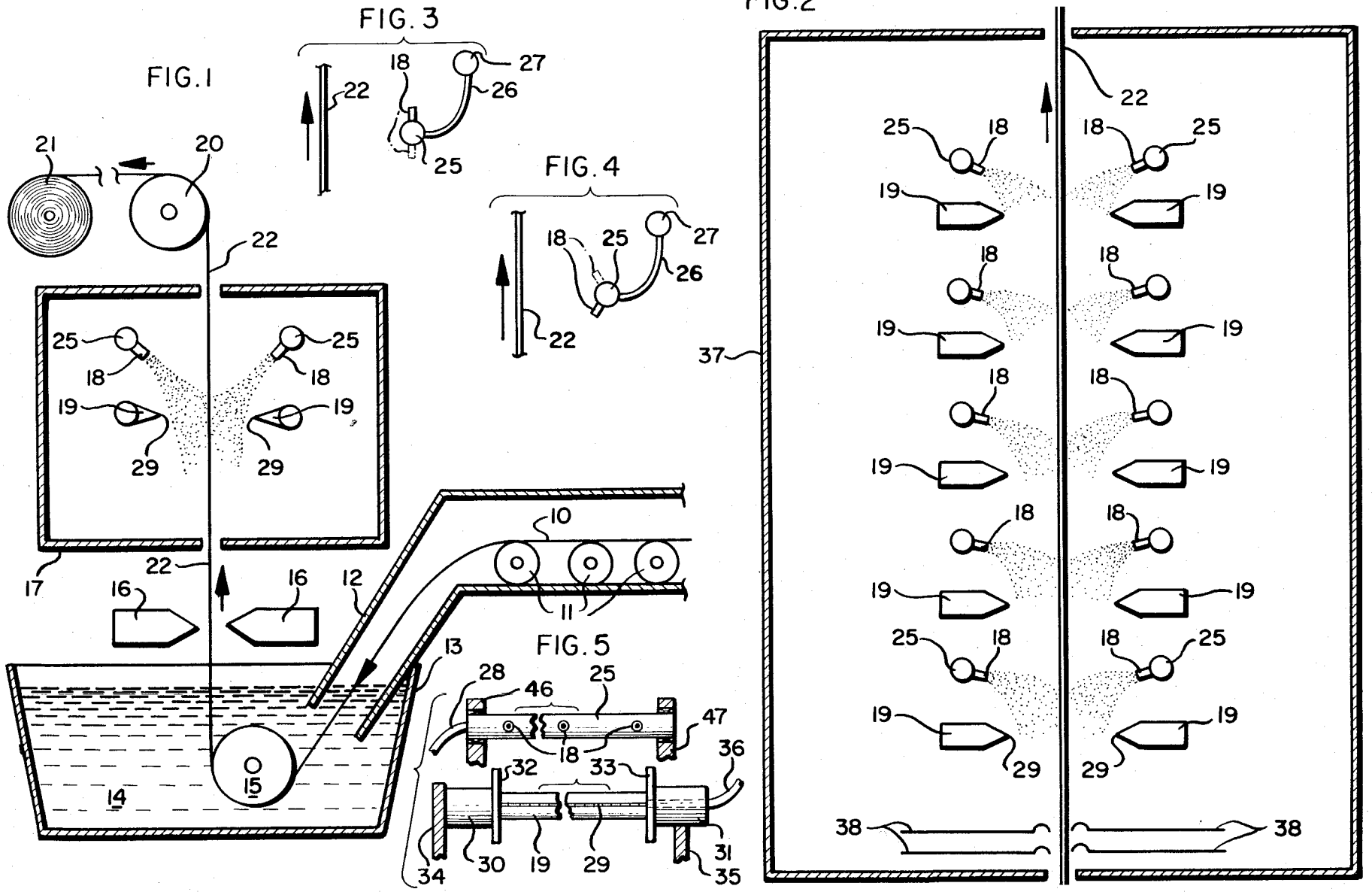
FIG. 1 is a diagrammatic side elevational view, partially in section, illustrating an embodiment of apparatus for minimizing spangling on a hot dip galvanized strip, in accordance with the present invention.
FIG. 2 is an enlarged elevational view, partially in section, of a portion of another embodiment of apparatus in accordance with the present invention.
FIG. 3 is a fragmentary side elevational view of a portion of the apparatus.
FIG. 4 is a view similar to FIG. 3.
FIG. 5 is a fragmentary end view of a portion of the apparatus.

Referring initially to FIG. 1, illustrated at 10 is an uncoated steel strip which is moved along rollers 11, 11 located within a hood 12 which extends into a vat 13 containing a bath 14 of galvanizing material, such as molten zinc or zinc alloy. Strip 10 is introduced into bath 14 where it is trained around a roller 15 and then is withdrawn from the bath upwardly between a pair of steam/air knives 16, 16. The strip is coated with galvanized material in bath 14, and as the coated strip 22 is withdrawn upwardly between knives 16, 16, the thickness of the zinc coating on the surface of the strip is controlled by a blast of fluid from knives 16, 16, in a conventional manner. The upwardly moving strip 22 enters a chamber 17 containing spray nozzles 18, 18 and corona blades 19, 19 constituting electrodes for producing an electrostatic field, as will be described later in more detail. The zinc coating on coated strip 22 has an exterior surface portion which is still molten as strip 22 enters chamber 17, and this molten exterior surface portion is solidified as strip 22 passes through chamber 17.

Upon exiting chamber 17, strip 22 passes around a roller 20 and is eventually wound into a coil 21.

Solidification of the molten exterior surface portion on coated strip 22 is aided by spraying against the exterior surface portion, from nozzles 18, 18, finely divided particles of a liquid coolant of nucleating agent such as water on an aqueous solution. Nozzles 18, 18 and corona blades 19, 19 are shown on both sides of coated strip 22, but the nozzles and corona blades need only be employed on one side of the strip, if desired.

An electrostatic field is created between coated strip 22 and electrodes 19, 19 within chamber 17 by connecting, in a conventional manner, strip 22 to one pole of an electrical energy source and connecting electrodes 19, 19 to the other pole. Typically, strip 22 is connected to ground and receives a positive charge while electrodes 19, 19 receive a negative charge. The voltage across the gap between strip 22 and electrodes 19, 19 is of sufficient magnitude to create an electrostatic field between strip 22 and electrodes 19, 19, all of which is accomplished in a conventional manner.

Particles of nucleating agent sprayed from nozzles 18, 18 are directed into the electrostatic field where the particles are charged with the same polarity as an electrode 19.

Nozzles 18, 18 are of a conventional type which may employ compressed air as a shearing medium for dividing a body of liquid nucleating agent into finely divided particles. These particles are typically in the size range 10–100 microns (0.01–0.1 mm).

When a particle of nucleating agent impinges against the molten exterior surface portion of coated strip 22, solidification of the molten galvanized material begins at the site of impingement. A solidification crystal grows outwardly from the site of impingement until it abuts against another solidification crystal growing outwardly from another site of impingement. The size of the solidification crystals or spangles affects the appearance of the coated strip. Spangles having a size larger than 1 mm are undesirable when the coated strip is to be painted.

Most of the particles sizes in the size range (10–100 microns) emanating from nozzles 18, 18 produce desirably small spangles smaller than 1 mm. For example, a particle having a 50 micron size produces desirably small spangles. In contrast, a particle having a 150 micron size produces an undesirably large spangle. As the particle size increases from 50 microns up to 150 microns, the spangle size gradually increases until it becomes undesirably large (i.e., exceeding 1 mm).

When coated strip 22 is impinged by a multiplicity of smaller particles within the size range produced by nozzles 18, 18, the size of the solidification crystals on the coated strip are substantially smaller than 1 mm, and the strip does not have an undesirably large spangled appearance. On the other hand, if strip 22 is impinged by larger particles in the size range produced by nozzles 18, 18, the coated strip can have undesirably large spangles, and if the strip is impinged by very large particles (3–5 mm), the strip will have an undesirable surface appearance. When the coated strip has large spangles or an undesirable surface appearance, it is unsuitable for painting.

In accordance with the present invention, the size of the particles which impinge against coated strip 22 can be controlled by controlling the direction in which the particles are moving when they enter the electrostatic field and the magnitude and extent of the electrostatic field. More particularly, the particles of nucleating agent are directed, in relation to vertically moving strip 22, so that at least the large particles in the size range follow a particle path which avoids impingement on the exterior surface portion of strip 22. In addition, the magnitude and extent of the electrostatic field are controlled so as to divert for impingement against the molten exterior surface portion of strip 22 only those particles of nucleating agent which produce the desirably small spangles. The magnitude and extent of the electrostatic field, as controlled in accordance with the present invention, is insufficient to divert the large particles for impingement against strip 22. Expressed in another way, the momentum of the large particles along their path resists diversion thereof for impingement against coated strip 22.

As is shown in the drawings, strip 22 is the only element of opposite polarity to which the particles of nucleating agent from nozzle 18 can be electrically attracted, and the surface on strip 22 is the only surface to which the small particles of nucleating agent can be directed by the electrostatic field.

As previously noted, the particles of nucleating agent have a mixed size range, including both small and large particles (as defined above), when the particles leave nozzles 18, 18 or are in the electrostatic field. All of the particles sprayed from nozzle 18, 18, initially enter the electrostatic field on the same directional path, but the small particles are segregated from the large particles in the electrostatic field at a location adjacent coated strip 22, and following this segregation, the small particles are attracted to the coated strip while the large particles continue along a path which avoids impingement with coated strip 22. The large particles have imparted thereto a momentum along their path which is so large that the force required for the task of diverting the large particles from their path and directing them toward strip 22 exceeds the force in the electrostatic field which is available for that task. There is no physical barrier between the particles and strip 22 at the location where the particles are segregated.

To assist the large particles to avoid impingement against coated strip 22 when the latter is moving in a vertical direction, the particles should have imparted thereto a vertical directional component, either straight up or straight down or, if inclined toward strip 22, the vertical component must be sufficiently large so that the momentum of the large particles in a vertical direction is greater than that which can be overcome by the electrostatic field.

In other words, for an electrostatic field having a given magnitude and extent, there is a range of angles, at which the particles may enter the field, which imparts to the large particles a momentum for avoiding impingement which the electrostatic field is incapable of overcoming. For some such angles of entry into the electrostatic field, the magnitude and extent of the field can be adjusted to vary the size of the particles which are attracted to coated strip 22. There are thus several variables for controlling the minimization of spangling.

For example, if coated strip 22 exits from chamber 17 with undesirably large spangles thereon, one way in which this can be corrected is to adjust the angle at which nozzles 18, 18 are directed towards strip 22. Another way of controlling the size of particles which impinge against coated strip 22 is to adjust the voltage of the electrostatic field, and a third way is to adjust the extent of the electrostatic field.

This third way is accomplished be employing a multiplicity of vertically spaced corona blades 19, 19 located alongside the vertically moving coated strip 22, as shown in FIG. 2. Thus, in the arrangement shown in FIG. 2, employing five sets of corona blades 19, 19 at vertically spaced intervals, the extent of the electrostatic field would be at a maximum when all five levels of corona blades are connected to the source of electrical energy. The extent of the electrostatic field can be decreased by disconnecting the corona blades 19, 19 at the bottom level, for example, or at the top level for example, or both. The electrostatic field would be at a minimum when only those corona blades 19, 19 at the middle level of the five levels shown in FIG. 2 are connected to the source of electrical energy. The corona blades at the various levels are connected to the source of electrical energy by a conventional electrical circuit employing conventional switches, not shown here.

The voltage or magnitude of the electrostatic field may be adjusted utilizing conventional voltage regulating devices, not shown here. Consistent with avoiding impingement of large particles of nucleating agent, the voltage employed in the electrostatic field should be as high as can be effectively utilized without causing arcing between the corona blades and the strip. The higher the voltage, the greater the attraction of the small particles toward the coated strip and the faster the solidification of the molten exterior surface portion on the strip.

Referring now to FIGS. 3–5, nozzles 18 are mounted on a header 25 in turn rotatably mounted on a pair of frame members 46, 47. Communicating with one end of header 25 is a flexible conduit 28 for transporting liquid nucleating agent to header 25.

Header 25, together with nozzles 18, may be rotated about the axis of header 25 to adjust the angle or direction in which nozzles 18 spray particles of nucleating agent. Once the nozzles 18 have been adjusted to the desired angle, the header 25 may be clamped at that position of angular rotation, employing conventional clamping means not shown. As an alternative, the nozzles may be individually angularly adjustable.

Communicating with each nozzle 18 is a flexible conduit 26 in turn communicating with a header 27 (FIGS. 3–4) for transporting compressed air for use as a shearing medium at nozzles 18 to divide a body of liquid nucleating agent into finely divided particles.

By mounting header 25 for rotation about its axis, the nozzles 18 may be adjusted between a position in which the nozzle is directed vertically upwardly (solid lines in FIG. 3) and a position in which the nozzle is directed vertically downwardly (dash-dot lines in FIG. 3), as well as positions therebetween in which the nozzle is pointed in a direction inclined toward coated strip 22 but having a substantial vertical component (FIG. 4).

When nozzle 18 is pointed vertically upwardly (solid lines in FIG. 3) and the particles are sprayed into the electrostatic field alongside strip 22, the large particles initially move vertically upwardly until the force of gravity overcomes the momentum in an upward direction, following which the large particles move downwardly. The large particles for the most part resist the attraction of oppositely charged strip 22 during at least their upward movement. The small particles exiting from nozzle 18 are, however, attracted to strip 22 while the large particles are moving upwardly.

Some of the large particles may be attracted to strip 22 during downward movement of the large particles following their initial upward movement. The proportion of large particles so attracted depends upon the length of the field through which the particles move during their descent. However, no adverse effects occur when large particles are attracted to strip 22 under these circumstances. This is because, in a given mixture of particles, those large particles which are attracted to the strip are attracted after the small particles, the latter having been attracted to the strip while the large particles were moving upwardly. By the time the large particles impinge, the small particles have already done their job to create desirably small spangles, and subsequent impingement by the large particles does not produce undesirably large spangles or the undesirable surface appearance characteristic of very large particles of nucleating agent.

When the nozzle is pointed vertically downwardly (dash-dot lines in FIG. 3) and the particles are sprayed into the electrostatic field, the large particles move downwardly out of the electrostatic field, resisting the attraction of coated strip 22, whereas the small particles are attracted to coated strip 22.

When the nozzle is inclined toward the coated strip, (e.g., at one of the angles illustrated in FIG. 4) the large particles have both vertical and horizontal directional components, but the forces which impel the large particles along a path which avoids impingement against coated strip 22 are greater than the forces which either urge or attract them for impingement against strip 22, at least until after the small particles have first impinged to create desirably small spangles.

In all the instances illustrated in FIGS. 3–4, a balancing of the variables, namely the direction in which nozzle 18 is pointed and the magnitude and extent of the electrostatic field, can be employed to avoid impingement against coated strip 22 of those particles of nucleating agent so large as to cause undesirably large spangles on the coated strip while permitting impingement of the small particles which cause desirably small spangles on the surface of the coated strip.

Referring again to FIG. 5, corona blade 19 is typically composed of stainless steel. Blade 19 converges to a tip 29 having a saw-tooth shape. Opposite ends of blade 19 are connected to respective blocks 30, 31, each composed of electrical insulating material and each mounted to a respective frame member 34, 35. Also located at opposite ends of corona blade 19 are baffles 32, 33 each composed of electrically insulative material. Electrically connected to one end of corona blade 19 is an insulated electric line 36 connecting the corona blade with a source of electrical energy.

Baffles 32, 33 at opposite ends of corona blade 19 prevent the escape in a lateral direction (to the left and to the right in FIG. 5), past the ends of the corona blade, of particles of nucleating agent which, if composed of a conductive material such as tap water, could form a conductive path leading away from corona blade 19 and causing a voltage leakage therefrom.

In the embodiment illustrated in FIG. 1, chamber 17 contains only a single set of nozzles 18, 18 and a single set of corona blades 19, 19. However, additional sets of nozzles 18, 18 and corona blades 19, 19 may be employed at vertically spaced intervals within a chamber 37, as shown in FIG. 2.

Located at the bottom of chamber 37 are baffle members 38, 38 for collecting large particles of nucleating agent which have avoided impingement against coated strip 22 and for preventing these particles of nucleating agent from entering the bath of molten galvanizing material located below chamber 37.

The nucleating agent comprises a liquid coolant such as tap water (which is conductive) or condensate water (which is non-conductive). The nucleating agent may also be composed of aqueous solutions containing dissolved salts, in which case the nucleating agent would be conductive. Examples of such nucleating agents include aqueous solutions of copper sulfate, sodium nitrate, sodium chloride, potassium chromate, potassium permanganate and diammonium phosphate. Non-conductive aqueous solutions may also be employed, and examples thereof include aqueous solutions of alcohol or benzene or other non-conductive organic solvents.

The nucleating agent must be composed of particles of liquid. A gas, such as dry steam, may not be employed as a nucleating agent in accordance with the present invention. The heat required to convert a liquid to a gas (e.g., liquid water to steam) is drawn from the coated strip 22 when the liquid nucleating agent impinges thereagainst, and this results in substantially faster cooling of the coated strip than would occur if it were impinged by dry steam. Wet steam, i.e., steam containing water in both gaseous and liquid form, may be utilized, so long as the large particles of liquid water in the wet steam are prevented from impinging against the coated strip, and this may be accomplished in accordance with the present invention as described above.

In a typical embodiment of the present invention, a coated strip 22 is withdrawn from bath 14 at a temperature of about 890° F. (477° C.), which is above the melting point of zinc. The zinc coating on strip 22, is regulated by steam/air knives 16, 16 to a thickness typically in the range 0.3–0.1 mm (0.012–0.039 in.). The electrostatic field located between coated strip 22 and corona blades 19, 19 has a voltage in the range 50–80 kilovolts with a current ranging from less than 1 to 6 milliamps. The wider the strip, the larger the current required to provide the desired electrostatic field.

The particles of nucleating agent sprayed into the electrostatic field from nozzles 18, 18 have a size in the range 10–100 microns.

For a coated strip 22 having a width of about 9 inches and moving at a linear velocity of 60 ft./min. (18.3 m/min.), there is needed to cool the strip approximately 0.075 gallons (0.28 liters) per minute for each surface of the strip. In this case, the nucleating agent is water initially at ambient temperature.

As noted above, the spangle size required to avoid the undesirable appearance is less than 1 mm. A hot dip galvanized steel strip produced in accordance with the present invention, has a spangle size in the range 0.05–0.5 mm (0.002–0.02 in.).

As previously noted, the electrostatic field co-operates with other factors, in accordance with the present invention, to divert the small particles of nucleating agent into impingement with the coated strip while permitting the large particles of nucleating agent to continue along a path which avoids impingement.

As used herein, the expression "while permitting the large particles of nucleating agent to continue along a path which avoids impingement" (or similar expressions) encompasses two situations, one in which the large particles never impinge the strip and the other in which at least some large particles impinge the strip but only after the small particles have impinged to create desirably small spangles; and the invention herein encompasses both situations.

Any combination of conditions or any procedure in accordance with the present invention which avoids impingement on the strip of those large particles which produce undesirably large spangles, as defined above, will also avoid impingement of the very large particles (3–5 mm) which produce the above-described undesirable surface appearance or undesirable surface texture.

Other advantages of employing an electrostatic field in accordance with the present invention are that it prevents or dissipates the formation of an insulative air boundary layer adjacent the coated strip as well as avoiding or dissipating the formation of an insulative steam layer adjacent the coated strip when the nucleating agent comprises water.

The foregoing detailed description has been given for clearness of understanding only, and no unnecessary limitations should be understood therefrom, as modifications will be obvious to those skilled in the art.

We claim:

1. A method for minimizing spangle size on a hot dip galvanized steel strip, said method comprising the steps of:

withdrawing, from a bath of molten zinc, a steel strip having at least one exterior surface portion comprising molten zinc;

moving said withdrawn strip away from said bath in a direction having a vertical component;

providing said coated strip with an electrostatic charge having a first polarity;

providing particles of nucleating agent for initiating solidification of said molten zinc on said exterior surface portion, said particles having a mixed size range comprising small and large particles;

directing said particles, in relation to said vertically moving strip, so that at least the large particles in said size range move along a particle path which avoids impingement on said exterior surface portion;

and charging said particles of nucleating agent with an electrostatic charge having a second polarity opposite said first polarity to divert the small particles from said particle path toward said molten exterior surface portion for impingement substantially thereon only to initiate solidification thereof, while permitting said large particles to continue along a non-impinging particle path;

the continuation along said non-impinging particle path being limited to substantially said large particles.

2. A method as recited in claim 1 wherein:

said large particles are of a size which, if used to initiate said solidification, produce undesirably large spangles;

and said small particles are of a size which produce desirably small spangles.

3. A method as recited in claim 2 wherein:

said desirably small spangles have a size less than about 1 millimeter and said undesirably large spangles exceed 1 millimeter.

4. A method as recited in claim 2 and comprising:

controlling the direction of said particles of mixed size range and the magnitude and extent of said electrostatic charge so as to divert for impingement against said molten exterior surface portion only those particles of nucleating agent which produce said desirably small spangles.

5. A method as recited in claim 2 and comprising:

controlling the direction of said particles of mixed size range and the magnitude and extent of said electrostatic charge so that the momentum of said large particles along said path resists diversion thereof for impingement against said molten exterior surface portion.

6. A method as recited in claim 2 wherein:

said particle sizes are in the range 10 to 100 microns.

7. A method as recited in claim 1 wherein:

said particles are directed in a direction having a vertical component.

8. A method as recited in claim 1 wherein:

said nucleating agent comprises a liquid coolant.

9. A method as recited in claim 7 wherein:

said nucleating agent is selected from a group comprising liquid water, wet steam, conductive aqueous solutions and non-conductive aqueous solutions.

10. A method as recited in claim 1 wherein said step of providing said particles comprises:

atomizing a substantially undivided body of liquid nucleating agent.

11. In a method for cooling a hot dip galvanized steel strip by impinging particles of nucleating agent against a moving strip surface coated with a layer of zinc of which at least the exterior surface portion is still molten, a procedure for avoiding undesirably large spangles caused by the impingement against said exterior surface portion of relatively large particles of nucleating agent, said procedure comprising the steps of:

providing a mixture of said large particles and of small particles of nucleating agent which produce desirably small spangles when they impinge against said exterior surface portion;

segregating said small particles from said large particles;

directing said large particles along a path adjacent said moving strip but which avoids impingement of said particles with said exterior surface portion;

the avoidance of impingement against said exterior surface portion being limited to substantially said large particles;

directing said small particles toward said exterior surface portion;

and employing an electrostatic field to segregate said particles and to direct said small particles toward substantially said exterior surface portion only.

12. In a method as recited in claim 11 wherein said procedure comprises:

directing all of said particles through said electrostatic field;

and imparting to said large particles a momentum along said path which is so large that the force required for the task of diverting said large particles from said path and directing said large particles toward said exterior surface portion exceeds the force in said electrostatic field which is available for that task.

13. In a method as recited in claim 12 wherein said procedure comprises:

moving said strip along a predetermined path having a vertical component;

and said directing step comprises directing at least said large particles along said path thereof in a direction having a vertical component.

14. In a method as recited in claim 11 wherein said procedure comprises:

initially directing said small particles in the same direction as said large particles, before said segregating step.

15. In a method as recited in claim 11 wherein said procedure comprises:

performing said segregating step at a location immediately adjacent said molten exterior surface portion, without any physical barrier between said particles and said strip.

16. In a method for cooling a hot dip galvanized steel strip by impinging particles of nucleating agent against a moving strip surface coated with a layer of zinc of which at least the exterior surface portion is still molten, a procedure for assuring that there impinge against said exterior surface portion substantially only small particles of nucleating agent which produce desirably small spangles when they impinge thereagainst, said procedure comprising the steps of:

providing adjacent said strip surface an electrostatic field having a magnitude and extent (a) capable of directing said small particles to said surface portion for impingement substantially thereagainst only but (b) incapable of doing so with respect to large particles which produce undesirably large spangles when they impinge against said molten exterior surface portion, when the particles enter said field in a direction having a predetermined range of angles relative to said strip surface;

the incapability of said electrostatic field to impinge particles against said surface portion being limited to substantially said large particles;

and introducing particles of nucleating agent comprising said small particles into said electrostatic field in a direction within said predetermined range of angles.

17. A method as recited in claim 16 wherein said procedure comprises:

employing, in said introducing step, nucleating agent which comprises said large particles.

18. A method as recited in claim 16 wherein:

said nucleating agent comprises particles having a size in the range 10 to 100 microns.

19. A method as recited in claim 16 wherein:

said nucleating agent comprises a liquid coolant.

20. A method as recited in claim 19 wherein:

said nucleating agent is selected from a group comprising liquid water, wet steam, conductive aqueous solutions and non-conductive aqueous solutions.

21. A method as recited in claim 1 wherein:

said strip is the only element of opposite polarity to which said particles of nucleating agent can be electrically attracted.

22. A method as recited in claim 11 wherein:

said exterior surface portion on the moving strip is the only surface portion to which said small particles of nucleating agent can be directed by said electrostatic field.

23. A method as recited in claim 16 wherein:

said strip surface is the only surface to which said small particles of nucleating agent can be directed by said electrostatic field.

* * * * *

UNITED STATES PATENT AND TRADEMARK OFFICE

CERTIFICATE OF CORRECTION

PATENT NO. : 4,500,561

DATED : February 19, 1985

INVENTOR(S) : YONG-WU KIM et al

It is certified that error appears in the above-identified patent and that said Letters Patent are hereby corrected as shown below:

Col. 8, line 22, "in the range 0.3-0.1 mm" should be

--"in the range 0.3-1.0 mm"--

Signed and Sealed this

*Twenty-fifth* Day of *June 1985*

[SEAL]

*Attest:*

DONALD J. QUIGG

*Attesting Officer*

*Acting Commissioner of Patents and Trademarks*